US005745018A

United States Patent [19]

Vangala

[11] Patent Number: 5,745,018

[45] Date of Patent: Apr. 28, 1998

[54] CERAMIC FILTER WITH A COPLANAR SHIELD

[75] Inventor: Reddy R. Vangala, Albuquerque, N. Mex.

[73] Assignee: Motorola Inc., Schaumburg, Ill.

[21] Appl. No.: 677,154

[22] Filed: Jul. 9, 1996

[51] Int. Cl.[6] ..... H01P 1/202

[52] U.S. Cl. ..... 333/202; 333/206

[58] Field of Search ..... 333/203, 206, 333/207, 202, 202 DB

[56] References Cited

U.S. PATENT DOCUMENTS

| | | | |
|---|---|---|---|
| 4,742,562 | 5/1988 | Kommrusch | 455/78 |
| 5,103,197 | 4/1992 | Turunen et al. | 333/202 X |
| 5,218,329 | 6/1993 | Vangala et al. | 333/206 |
| 5,278,527 | 1/1994 | Kenoun et al. | 333/202 |

FOREIGN PATENT DOCUMENTS

| | | | |
|---|---|---|---|
| 508733 | 10/1992 | European Pat. Off. | 333/202 DB |
| 4061501 | 2/1992 | Japan | 333/202 DB |

*Primary Examiner*—Benny Lee

*Attorney, Agent, or Firm*—Gary J. Cunningham; Colin M. Raufer

[57] ABSTRACT

A ceramic filter with a coplanar shield which has: a filter body (302) comprising a block of dielectric material having top (304), bottom (306) and side surfaces (308,310,312, 314), and having a plurality of metallized through holes (316) extending from the top (304) to the bottom (306) surfaces defining resonators; a metallization layer substantially coating the bottom (306) and the side surfaces (306, 310,312,314), and the top surface (304) having a metallized pattern thereon defining a top pattern; input-output pads (318); and a conductive shield (322) having standoff legs (324) which maintain the conductive shield at a predetermined height above the top pattern of the filter body, the standoff legs (324) are connected to a portion of the top pattern on the top surface of the filter at a desired distance from the side surface having the input-output pads.

12 Claims, 3 Drawing Sheets

CERAMIC FILTER WITH A COPLANAR SHIELD

FIELD OF THE INVENTION

This invention relates to ceramic filters, and particularly to ceramic filters with a coplanar shield.

BACKGROUND OF THE INVENTION

The design and use of filter circuitry for filtering a signal of undesired frequency components is well known. It is also known that these filters can be fabricated from ceramic materials having one or more resonators formed therein.

Many conventional ceramic block filters are comprised of parallelepiped shaped blocks of dielectric material through which many holes extend from one surface to an opposite surface. Often, these filters use printed capacitors on the top surface in order to obtain the desired frequency characteristics of the filter.

It is well known that the top end of the resonators in a block filter have strong electric fields radiating thereform. These electric fields may adversely effect circuitry surrounding the filter in a radio or other communication device or apparatus which requires signal processing. These radiating electric fields may also adversely effect the performance of the filter itself. In conventional filters, electric field radiation is minimized by enclosing the filter in a grounded metal housing.

Electric field radiation may also be reduced by enclosing or otherwise confining the top surface of the filter in a metal grounded bracket, which is typically soldered to the exterior sides of the block filter. Another alternative involves the use of L-shaped stamped metal shields which are mounted to a side surface of the filter and wrap around to protect the top surfaces of the filter.

Unfortunately, the use of L-shaped stamped metal shields presents a variety of problems during the manufacturing stage of the shielded filter and additional problems when the filter is placed onto a circuit board in communications devices. Problems include the areas of soldering, adhesion, parallelism, coplanarity, size, weight, and the number of processing steps. Perhaps the greatest problem for a manufacturer which uses the filter is the fact that the bottom edge of the L-shaped stamped metal shield must be properly soldered to the circuit board to assure proper grounding of the ceramic filter. This problem is compounded by the variation in the ceramic block dimensions due to filter manufacturing process tolerances, even though the shield dimensions can be well controlled.

It would be considered an improvement in the art to provide a ceramic filter with a coplanar shield design which is entirely self-contained and which does not have to be connected to the circuit board while also providing the advantages of standardizing input-output footprints on various ceramic filter designs and decreasing the area required on the circuit board, while relieving the end user of the burden of ensuring a good connection between the floating edge of the shield and the circuit board.

DETAILED DESCRIPTION OF THE PREFERRED EMBODIMENT

Figure 1:
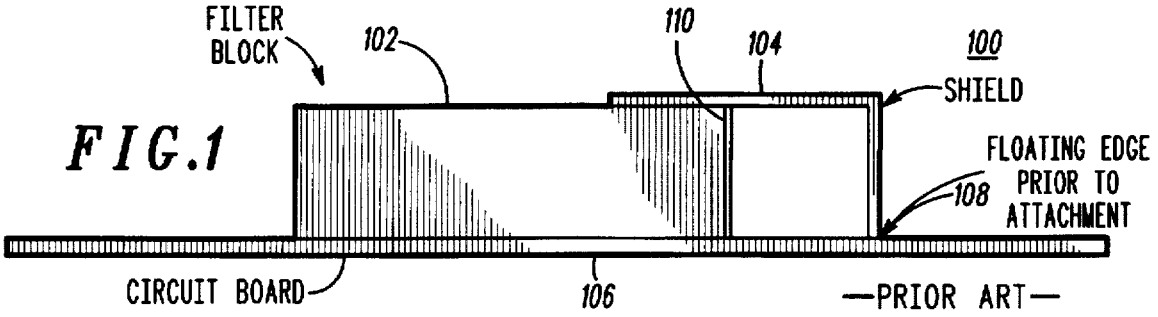
FIG. 1 shows a side view of a prior art shielded ceramic filter attached to a printed circuit board in which the floating edge of the L-shaped shield is co-planar with the input-output pad side surface of the ceramic block.

FIG. 1 shows a side view of a prior art shielded ceramic filter attached to a printed circuit board. As can be seen from this drawing, a ceramic filter 100 is provided. It includes a ceramic filter block 102 with a shield 104 attached in such a manner that the floating edge of the shield is soldered directly to the circuit board 106 in order to close the electrical ground loop. The floating edge is defined to be the edge produced by the thickness dimension of the shield. The point of attachment of the shield to the circuit board is shown as 108 in FIG. 1. A conductive top pattern is shown as 110 in FIG. 1.

The present invention is better understood with reference to FIGS. 2–6. In the present invention, the shield is substantially, entirely attached directly to the ceramic block filter. By attaching the shield in this manner, many processing and manufacturing advantages can be realized.

In the prior art, to assure coplanarity between the floating edge of the shield and the bottom surface of the block, the shield is trimmed after it is attached to the block. This step is necessary due to the dimensional non-uniformity of the ceramic filter blocks after they are fired. Each individual filter shield is "trimmed" to assure coplanarity between the input-output pads which are mounted to the circuit board and the floating edge of the shield which is also mounted to the circuit board. The ceramic filter with the coplanar shield design of the present invention, minimizes or eliminates the need for a trimming processing step altogether, resulting in a savings in both time and cost.

The advantages of the present invention to the manufacturer who uses these ceramics filters cannot be understated. In addition to the repeatable performance of this filter shield design, the manufacturer also achieves improved reliability, greater quality, and easier assembly operations. The filter shield design of the present invention can result in less down time and greater throughput. Additionally, a manufacturer can realize fewer repair steps and eliminate inspection steps with the present invention.

Figure 2:
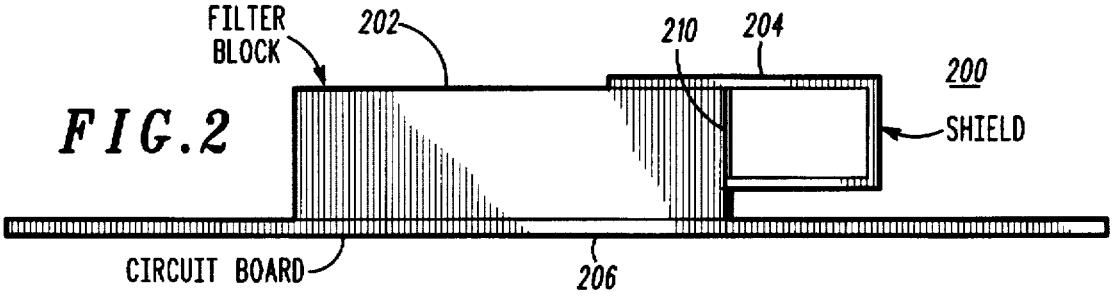
FIG. 2 shows a side view of a shielded ceramic filter attached to a printed circuit board in accordance with the present invention.

FIG. 2 shows a side view of the shielded ceramic filter attached to a printed circuit board. A ceramic filter 200 is provided, with a ceramic filter block 202 and a shield 204 attached in such a manner that the shield is soldered directly to a conductive top pattern 210 on a top surface of the block 202. Thus, the direct attachment of the shield to the circuit board 206 in order to close the electrical ground loop is no longer required, as is required in the prior art.

Another advantage of the present invention is that the top surface of the filter blocks require a very flat surface when the top pattern is applied. Consequently, a prior processing step in the manufacture of these filters involves a step to assure that the top surface of the filter is flat. Since the shield design of the present invention attaches the shield directly to the conductive top pattern of the filter, there will be a consistent gap between the filter and the shield, resulting in consistent electrical response and higher yield in the filters.

The present invention offers significant advantages during the electrical testing stages of the filter manufacturing process. A fabricated ceramic filter must meet many pertinent electrical specifications before it can be sent to the end user. Typically, the electrical properties which are tested include insertion loss, return loss, center frequency and bandwidth. The fixturing required to test these parameters can be complex and become even more difficult when the shield must be separately grounded in order to perform the tests. With the filter 200, the shield design is one in which the shield is grounded directly to the top surface conductive pattern of the filter block, thus eliminating difficult test fixture grounding problems and resulting in accurate electrical testing of the filters. Thus, the filter 200 offers significant advantages in the assembly of shielded ceramic block filters.

Figure 3:
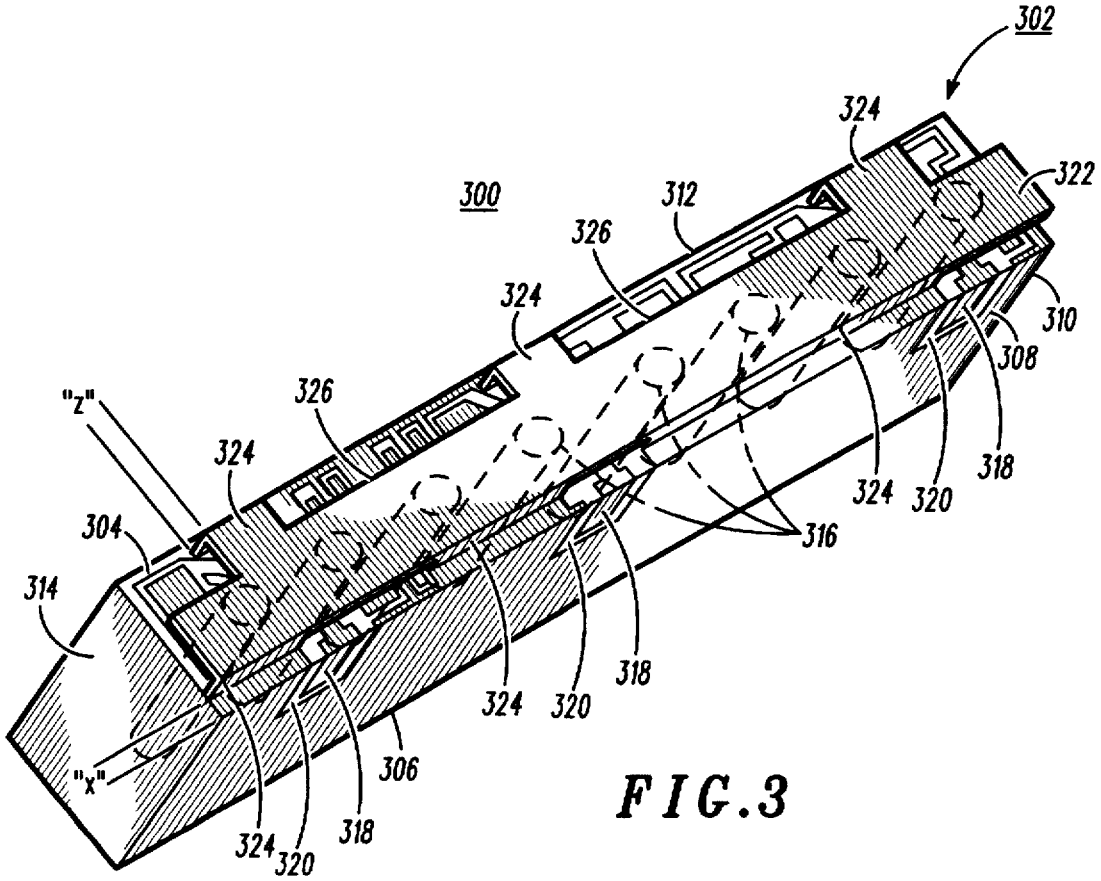
FIG. 3 shows a top, perspective view of the shielded filter shown in FIG. 2, in accordance with the present invention.

FIG. 3 shows a three dimensional view of the shielded filter shown in FIG. 2. FIG. 3 shows a shielded filter 300 with a coplanar shielding design. This view shows a filter body 302 comprising a block of dielectric material having a top surface 304, bottom surface 306, and side surfaces 308, 310, 312, and 314. Also shown (in phantom) in FIG. 3, are a plurality of metallized through holes 316 extending from the top 304 to the bottom 306 surface of the filter defining resonators. All exterior surfaces of the filter 304, 306, 308, 310, 312, 314, as well as the through holes 316 are substantially coated with a metallization layer. The top surface 304 of the filter has a conductive pattern thereon. The input and the output terminals are shown on a side surface in FIG. 3 as 318 surrounded by unmetallized areas 320. In the embodiment of the invention shown in FIG. 3, a duplex filter is shown having two input ports and a common output port. However, the present invention could also be applied to a filter having a single input and a single output port.

The conductive shield 322 is also shown having standoff legs 324 which keep the shield at a predetermined height "Z" above the top surface 304 of the filter body. Similarly, the shield is attached at a predetermined distance "X" away from the surface of the circuit board. On a rear portion of the shield are openings 326 within the conductive shield 322 define tuning windows which allow the individual resonators to be tuned. As can be clearly seen from FIG. 3, the conductive shield 322 is attached directly to the top surface 304 of the ceramic filter body.

Substantial flexibility for an end user is achieved with the shield design of the present invention. Since the manufacturer is no longer required to attach the shield directly to the circuit board, the manufacturer has a greater degree of freedom when designing the layout of the circuit board. By attaching the shield directly to the filter block, the filter block has a footprint which is compatible with many other ceramic filters. This may result in greater savings in both time and cost for a manufacturer who can streamline designs and products.

Another subtle but potentially applicable advantage of the filter 300 involves the increase in real estate or surface area on the circuit board as a result of the design of the shield attachment technique. The shield 322 can be attached directly to the top ground conductive pattern on the top surface of the filter. Thus, other components can be placed on the board in the region that was previously used to attach the shield to the circuit board. By increasing the proximity of the components in the completed electronic apparatus, a reduction in volume can be realized. Reduction in volume is a driving force in many areas of the electronics and communications industries.

Figure 4:
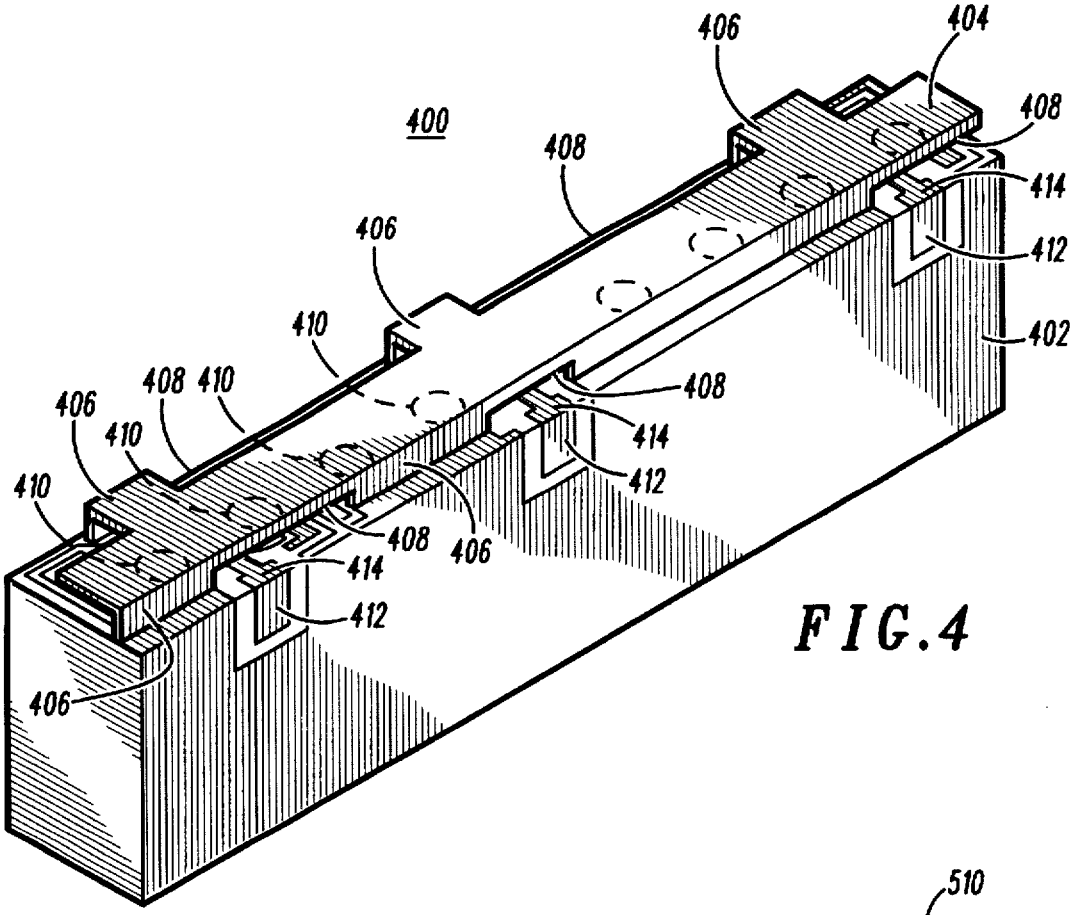
FIG. 4 shows a side, perspective view of the shielded filter shown in FIG. 2, in accordance with the present invention.

FIG. 4 shows another three dimensional view of the shielded filter shown in FIG. 2. FIG. 4 shows a ceramic filter 400 having a filter body 402 and a conductive shield 404. Filter 400 also contains through-holes 410 substantially coated with a metallization layer. The shield contains a plurality of standoff legs 406 on a front. Positioned between the standoff legs are a plurality of tuning windows 408 through which individual resonators can be accessed. From this view, what is significant is that the tuning windows 408 are provided such that the conductive shield 404 is not electrically shorted to the input-output pads 412 or their corresponding transmission lines 414.

A ceramic block filter having a top surface completely encased in a metal bracket or housing which serves as a shield could provide a perfectly functional filter. However, during manufacturing, it is often necessary to tune the individual resonators of the ceramic block filter in order to adjust the filter response. Since this often requires the introduction of a tuning device directly on the top surface of the filter, a series of tuning windows can be placed in the shield in order to accommodate the tuning of the windows. The present invention contemplates a variety of filter shield designs having a variety of tuning window designs which will depend on the electrical layout of the filter. The tuning windows can increase in both size and number to the extend that the shield still performs its function of protecting the filter from stray electromagnetic paths.

As the discussion above reveals, the greatest benefits of the ceramic filter with the coplanar shield design are realized during assembly, testing, inspection, and other manufacturing operations. Since the ground loop of the filter is closed on the filter itself, electrical testing of the filter becomes both reliable and repeatable.

In FIGS. 1–5, the shield is shown applied to duplexer filters having three input-output ports. However, the present invention can be used with any ceramic block filter having a need for shielding, so long as the shield can be bonded directly to a portion of the top surface of the filter block. In a preferred embodiment, the ceramic filter 400 has a top surface which is substantially metallized or contains a sufficient amount of ground conductor metallization to facilitate shield attachment.

The actual method of attachment or bonding of the shield to the ceramic filter can vary according to the manufacturing technologies. At present, most shields are soldered to the metallized surface of the ceramic filter block. In order to achieve a sufficiently strong and durable bond, a metallization layer of at least a few hundred micro-inches is desirable. However, other methods of shield attachment are contemplated by the present invention. Certainly welding techniques or use of an electrically conductive adhesive could also be used to achieve a similar result. Also, as metallization and adhesive technologies advance, other bonding techniques may be employed without departing from the novel spirit and scope of this invention.

Similarly, the actual shielding material can be varied based upon the exigencies of the situation. Presently, tin-coated steel metal shields are used having a thickness in the range of 0.005 inches to 0.010 inches. However, any conductive material which serves to shield the filter block from harmful stray electric fields could be used for the present invention. The use of tin-coated steel shields, however, offers the advantage of being a component which can be stamped and pressed into a shape which has a right angle for the standoff legs, and can be pressed into a shape that has very tight tolerances. Thus, the desirable coplanarity with the top surface of the filter block is easily maintained.

The top pattern ground design is an important aspect of this invention which allows the shield to mounted directly onto the top surface of the filter block. Thus, the top metallization pattern must be designed such that the proper inter-resonator coupling is maintained, while at the same time, sufficient surface area is preserved to allow attachment of the shield to the top surface of the filter block. The top surface of the filter must be substantially metallized in order to provide an area sufficiently large enough to attach the shields. Typically, the shields need to be attached such that they can survive a pull test of approximately 25.0 pounds per inch.

The area of the shield relative to the top surface of the block is such that the shield should substantially cover the block, particularly covering the resonator through-holes in the filter block. Of course, large areas of open space may be present in the regions containing the tuning windows.

Figure 5:
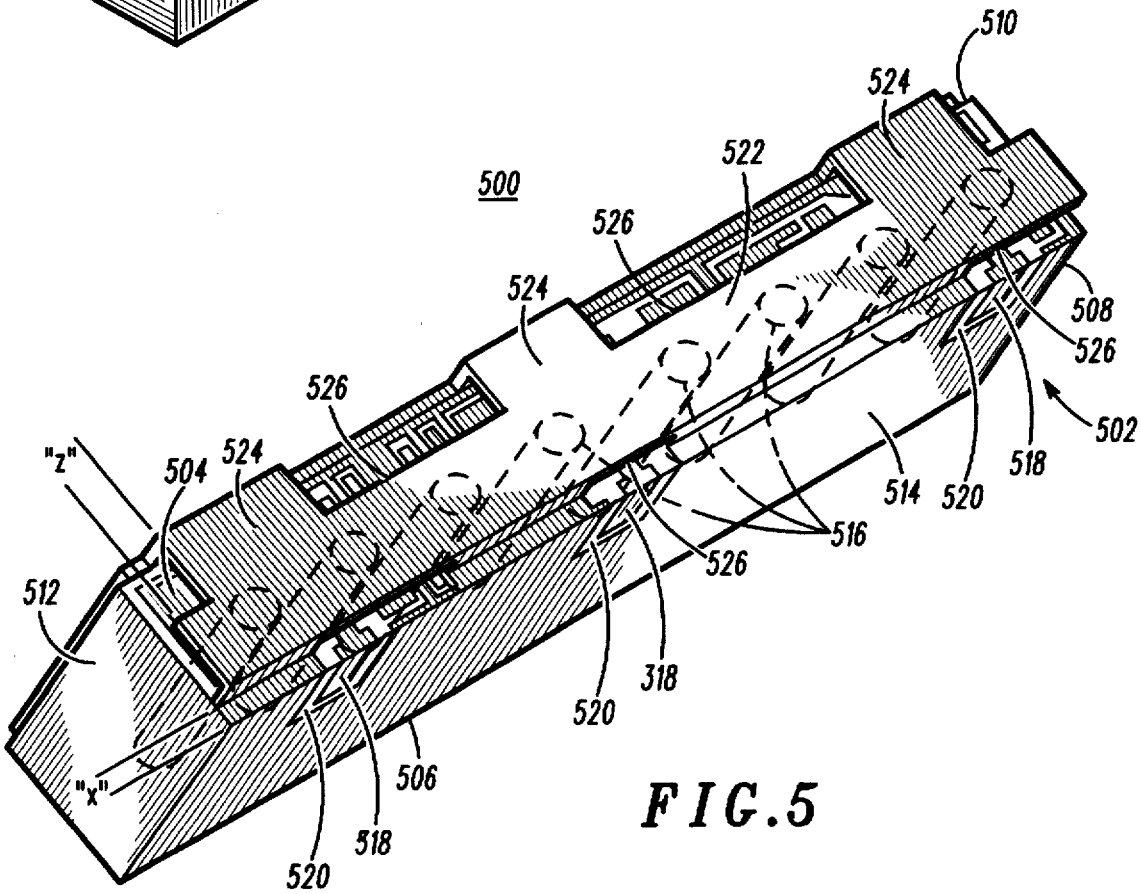
FIG. 5 shows another embodiment of the ceramic filter with a coplanar shield, in accordance with the present invention.

Another embodiment of the present invention is shown as FIG. 5. In this embodiment, the shield still is not connected directly to the circuit board, however, the shield stand-off legs on the side surface opposite the input-output pad side surface extend down the side of the block. One useful feature of this design is the fact that since the side surfaces are substantially coated with a metallization layer, a relatively large surface area exists on which the shield can be attached. This wraparound shield design still maintains a ground loop which is independent of the circuit board.

More particularly, FIG. 5 shows a shielded filter 500 with a coplanar shielding design. This view shows a filter body 502 comprising a block of dielectric material having a top surface 504, bottom surface 506, and side surfaces 508, 510, 512, and 514. Also shown in FIG. 5 are a plurality of metallized through holes 516 (in phantom) extending from the top 504 to the bottom 506 surface of the filter defining resonators. All exterior surfaces 504, 506, 508, 510, 512, 514, of the filter as well as the through holes 516 are substantially coated with a metallization layer. The top surface 504 of the filter has a conductive pattern thereon. The input and the output terminals 518 are shown in FIG. 5 surrounded by unmetallized areas 520. In this embodiment, a duplex filter is shown having two input ports and a common output port. However, the present invention can be used in connection with a filter having a single input and a single output port.

The conductive shield 522 is also shown having standoff legs 524 which keep the shield at a predetermined height "Z" above the filter body. Similarly, the shield is attached at a predetermined distance "X" away from the surface of the circuit board. The openings 526 within the conductive shield 522 define tuning windows which allow the individual resonators to be tuned. As can be clearly seen from FIG. 5, the conductive shield 522 is attached directly to the top surface 504 of the ceramic filter body. In a preferred embodiment, the conductive shield 522 actually extends onto one of the side surfaces of the filter body 510 which is opposite the side surface of the filter body 514 containing the input-output pads 518. In this embodiment, the conductive shield can be very securely attached to the filter body 502 due to the large surface area of metallization on the side surface 510 of the filter block.

Figure 6:
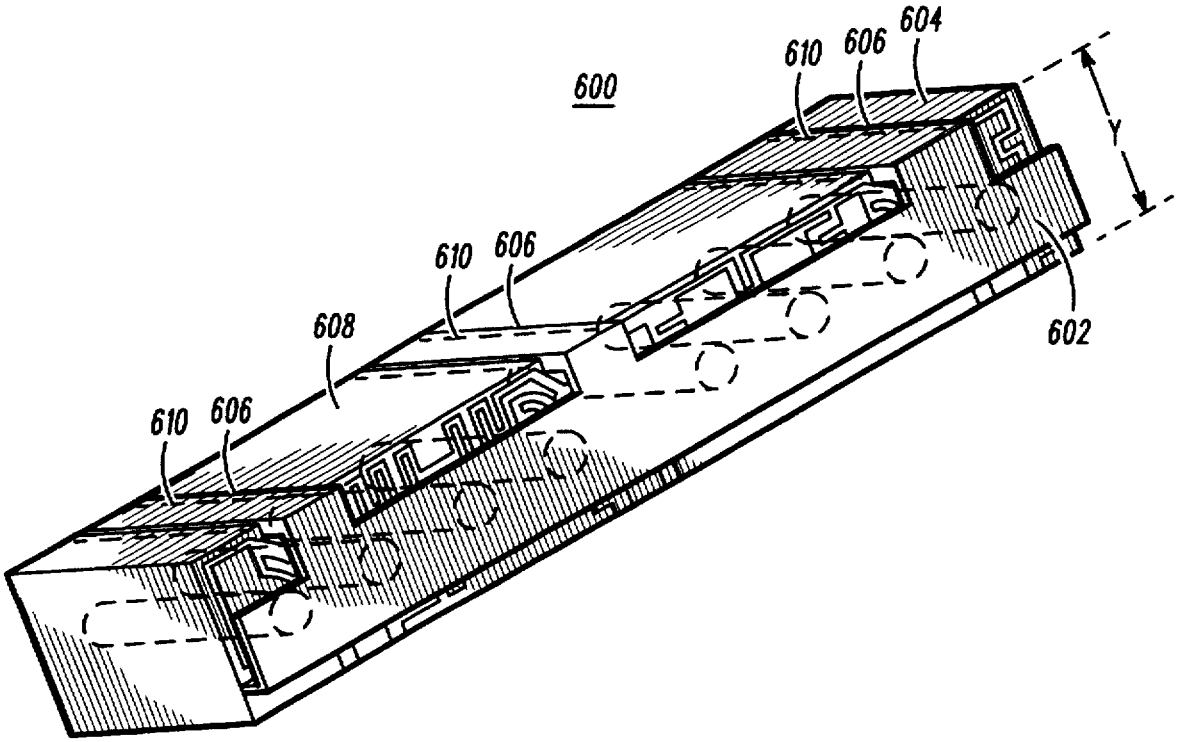
FIG. 6 shows another embodiment of the ceramic filter with a coplanar shield, in accordance with the present invention.

FIG. 6 shows yet another embodiment of the ceramic filter with coplanar shield design. This embodiment contains features of the embodiment shown in FIG. 5, as well as other potentially desirable features. In the embodiment shown in FIG. 6, a shielded ceramic filter 600 is provided. The filter comprises a block of dielectric ceramic 604, having a conductive shield 602 attached thereto. In this embodiment, the standoff legs 606 extend onto a side surface 608 of the filter, and the standoff legs 606 rest inside correspondingly configured troughs 610 which are present on the side surface 608 of the filter. Thus, the overall height of the shielded filter above a circuit board, denoted as "Y" in FIG. 6, will substantially always remain constant. In other words, with the shield attachment design shown in FIG. 6, the shield has the advantage of being securely attached to the side surface 608 of the filter without any gain in the overall height "Y" of the filter above a circuit board.

Although various embodiments of this invention have been shown and described, it should be understood that various modifications and substitutions, as well as rearrangements and combinations of the preceding embodiments can be made by those skilled in the art, without departing from the novel spirit and scope of this invention.

What is claimed is:

1. A ceramic filter with a coplanar shield, comprising:

a filter body comprising a block of dielectric material having top, bottom and side surfaces, and having a plurality of metallized through holes extending from the top to the bottom surfaces defining resonators in the filter body;

a metallization layer substantially coating the bottom and the side surfaces, and the top surface having a metallized pattern thereon defining a top pattern;

at least a first and a second input-output pad comprising an area of conductive material on one of the side surfaces and substantially surrounded by an unmetallized area of the metallization layer on the one side surface of the metallization layer; and a conductive shield having a plurality of standoff legs which maintain the conductive shield at a predetermined height above the top pattern of the filter body, the standoff legs are connected to a portion of the top pattern on the top surface of the filter at a predetermined distance from the one side surface having the at least first and second input-output pads.

2. The ceramic filter of claim 1, wherein the conductive shield has openings therein defining tuning windows on at least one of a front and a rear section thereof.

3. The ceramic filter of claim 1, wherein the conductive shield comprises a tin-coated steel metal.

4. The ceramic filter of claim 1, wherein the conductive shield comprises a thickness of about 0.005 inches to about 0.01 inches.

5. A ceramic filter with a coplanar shield, comprising:

a filter body comprising a block of dielectric material having top, bottom and side surfaces, and having a plurality of metallized through holes extending from the top to the bottom surfaces defining resonators in the filter body;

a metallization layer substantially coating the bottom and the side surfaces, and the top surface having a metallized pattern thereon defining a top pattern;

at least a first and a second input-output pad comprising an area of conductive material on one of the side surfaces and substantially surrounded by an unmetallized area of the metallization layer on the one side surface of the metallization layer; and a conductive shield having a first and a second plurality of standoff legs which maintain the conductive shield at a predetermined height above the top pattern on the top surface of the filter body, the first plurality of standoff legs are coupled to the top pattern and the second plurality of standoff legs are coupled to the metallization layer on the side surface of the filter body opposite the one side surface having the at least first and second input-output pads.

6. The ceramic filter of claim 5, wherein the second plurality of standoff legs comprise a continuous sheet of metal, in a generally L-shape.

7. The ceramic filter of claim 5, wherein the conductive shield has openings therein defining tuning windows.

8. The ceramic filter of claim 5, wherein the conductive shield has openings therein defining tuning windows on at least one of a front and a rear section thereof.

9. The ceramic filter of claim 5, wherein the conductive shield comprises a tin-coated steel metal.

10. The ceramic filter of claim 5, wherein the conductive shield comprises a thickness of about 0.005 inches to about 0.01 inches.

11. A ceramic filter with a coplanar shield, comprising:

a filter body comprising a block of dielectric material having top, bottom and side surfaces, and having a plurality of metallized through holes extending from the top to the bottom surfaces defining resonators in the filter body;

a metallization layer substantially coating the bottom and the side surfaces, and the top surface having a metallized pattern thereon defining a top pattern;

at least a first and a second input-output pad comprising an area of conductive material on one of the side surfaces and substantially surrounded by an unmetallized area of the metallization layer on the one side surface of the metallization layer; and a conductive shield having a first plurality of standoff legs on a front section thereof which maintain the conductive shield at a predetermined height above the top pattern on the top surface of the filter body, the first plurality of standoff legs are connected directly to a portion of the metallized pattern on the top surface of the filter, and the conductive shield having a second plurality of standoff legs connected to a plurality of substantially complimentarily-configured troughs on the side surface of the filter body opposite the one side surface having the at least first and second input-output pads.

12. The ceramic filter of claim 11, wherein the conductive shield has openings therein defining tuning windows.

* * * * *